United States Patent [19]

Correard

[11] Patent Number: 4,961,536

[45] Date of Patent: Oct. 9, 1990

[54] PNEUMATIC LIQUID SPRAYING DEVICE

[76] Inventor: Jean-Yves Correard, 2 Allée de la Draye, 38610 Gieres, France

[21] Appl. No.: 346,614

[22] Filed: May 2, 1989

[30] Foreign Application Priority Data

May 3, 1988 [FR] France ..... 88 05926

[51] Int. Cl.[5] ..... B05B 1/28

[52] U.S. Cl. ..... 239/296; 239/300

[58] Field of Search ..... 239/296, 297, 299, 300

[56] References Cited

U.S. PATENT DOCUMENTS

| | | | |
|---|---|---|---|
| 2,070,696 | 2/1937 | Tracy | 239/296 X |
| 2,646,314 | 7/1953 | Peeps | 299/140.1 |
| 4,501,394 | 2/1985 | Kwok | 239/296 |
| 4,650,119 | 3/1987 | Pomponi, Jr. | 239/413 X |
| 4,767,057 | 8/1988 | Degli et al. | 239/296 |
| 4,844,347 | 7/1989 | Konhäuser et al. | 239/296 |

FOREIGN PATENT DOCUMENTS

| | | | |
|---|---|---|---|
| 434163 | 5/1939 | Belgium . | |
| 0224066 | 6/1987 | European Pat. Off. . | |
| 240377 | 10/1987 | European Pat. Off. | 239/296 |
| 0283957 | 9/1988 | European Pat. Off. . | |
| 1524334 | 5/1968 | France . | |

*Primary Examiner*—Andres Kashnikow
*Assistant Examiner*—William Grant
*Attorney, Agent, or Firm*—Spensley Horn Jubas & Lubitz

[57] ABSTRACT

A pneumatic liquid spraying device comprising a spray nozzle with a liquid ejection channel, spraying air ejection channels and at least one entrainment air ejection channel coaxial and parallel to said liquid ejection channel, these channels emerging on the same frontal face of the nozzle, characterized in that at least one entrainment air ejection channel is independent of the other aforementioned air channels and is designed to be supplied by specific compressed air.

11 Claims, 2 Drawing Sheets

PNEUMATIC LIQUID SPRAYING DEVICE

FIELD OF THE INVENTION

The invention relates to a pneumatic liquid spraying device, in particular for the application of paint or varnish; its main object is to obtain better conformation of the stream of sprayed liquid and greater ease of adjustment of the characteristics of the said stream, enabling the latter to be adapted swiftly to changes or variations in the conditions of flow, temperature and viscosity of the liquid to be sprayed.

THE PRIOR ART

There is known a liquid spraying device using compressed air both to transform the liquid into a stream of fine particles and to give this stream a desired form, more particularly a relatively flat fan shape, with a cross-section having as constant a thickness as posssible.

Such a device is described, for example, in U.S. Pat. No. 6,646,314. This prior art device comprises a spray nozzle in the centre of which are disposed a liquid ejection channel and an entrainment air ejection channel, annular and coaxial with the said liquid ejection channel. In addition, the nozzle comprises a number of air ejection channels which, by reason of their respective main functions, will be called spraying air ejection channels and stream forming air ejection channels. The said spraying air ejection channels are arranged symmetrically on either side of the axis of the liquid ejection channel and converge towards a point on this axis (which will be called "spraying point" for the sake of convenience) located downstream of the liquid ejection orifice, to disperse the jet of liquid in fine droplets. The said forming air channels are also arranged symmetrically on either side of this axis and converge towards it two by two, downstream of the spraying point, that is to say towards a location at which the jet of liquid is already sprayed. For this purpose, these channels are provided in two horns projecting from the surface of the nozzle on which emerges the liquid ejection channel. These horns are symmetrical in relation to the axis of the channel. The effect of the "shaping air" is thus to flatten out the stream of sprayed liquid to give it the desired fan shape. In known arrangements, at least all the channels emerging on the face of the nozzle in the centre of which is located the orifice of the said liquid ejection channel (i.e. in particular the entrainment air ejection channel and the spraying air ejection channels) are supplied by the same compressed air souce. Simply speaking, the internal orifices of these channels all emerge in the same annular cavity disposed about the liquid ejection channel. The forming air ejection channels, located in the horns, are generally supplied separately, i.e. connected to another compressed air inlet, of a different pressure.

It is generally agreed that the air ejected by the horns chiefly permits adjustment of the width of the flat jet while the air ejected by the entrainment channels and the spraying channels acts on another important parameter, namely spraying fineness. In fact, the actions of all these jets of air interfere, which makes adjustments difficult, lengthy and laborious. For example, if it is wished to increase the fan-shaped spread of the stream, it is necessary to increase the air pressure supplying the channels located in the horns. This has two unsought after consequences, particularly at low liquid flow rates. On one hand, there is a risk of the fan-shaped stream being thinned, or even cut off in the centre, at the point where the action of the air from the horns is preponderant and, on the other hand, the spray becomes finer. These variations thus have to be corrected by reducing concurrently the spraying air flow rate and, as a result, the entrainment air flow rate, which has further effects on the shape of the stream and thus compels the operator to proceed in successive approximations.

From another viewpoint, if it is wished to change the flow rate of liquid to be sprayed, or simply to adapt the spraying conditions to a liquid of a different nature (in particular, a paint of a different viscosity), one has to modify the air pressure supplying the spraying air ejection channels, which also results in variations in the shape and/or the dimensions of the stream. It is then necessary to current these variations by acting on the other source of compressed air, etc.

The invention is the result of observing that, in this type of device, the spraying air also contributes to the formation of the sprayed stream and to the distribution of the sprayed liquid, transversely to the axis of the stream (i.e. in the "plane" of the fan), while the entrainment air has practically no effect on these parameters. On the other hand, the entrainment air directly influences the forward velocity component, imparted to the particles of sprayed liquid, hence on the spread of the fan. Consequently, the invention proposes changes in the supply of the different air ejection channels described above, with the aim of making the adjustments of the main characteristic parameters of the stream relatively independent of one another.

SUMMARY OF THE INVENTION

Pneumatic liquid spraying device comprising a spray nozzle in the centre of which is provided a liquid ejection channel and further comprising stream shaping air ejection channels, spraying air ejection channels and at least one entrainment air ejection channel, the entrainment air ejection channel or channels being provided coaxially and parallel to said liquid ejection channel and emerging on one frontal face of said spray nozzle on which also emerges said liquid ejection channel, characterized in that said spraying air ejection channels emerging on said frontal face, said at least one entrainment air ejection channel is independent of the other aforementioned air channels and is designed to be supplied by specific compressed air at a pressure generally different from that (those) of the other aforementioned air ejection channels.

In other words, the invention consists, in the first place, in dissociating the adjustment of the supply air of the entrainment air ejection channel from the other adjustments. This can thus lead, in accordance with the invention, to providing three sources of compressed air at different pressures and adjustable independently of one another: one air source for the said entrainment air ejection channel, one air source for the said spraying air ejection channels and one air source for the said stream forming air ejection channels, i.e. the air ejected by the aforementioned horns.

The invention quite especially concerns, however, a form of embodiment in which the number of compressed air sources is confined to two, which makes it possible, on hand, to connect the device to classical and/or already existing installations and, on the other hand, to further facilitate adjustments while unexpectedly improving performances. According to this currently preferred form of embodiment, the said stream forming air is dependent upon the spraying air.

More precisely, the invention thus also concerns a device according to the above definition, characterized in that the said spraying air ejection channels and the said stream shaping air ejection channels communicate.

The invention will be more readily understood and further advantages thereof will become more clearly apparent in the light of the discription that follows of an embodiment of a device according to its principle, given solely by way of example and with reference to the annexed drawings, wherein.

DETAILED DESCRIPTION OF THE INVENTION

Figure 3:
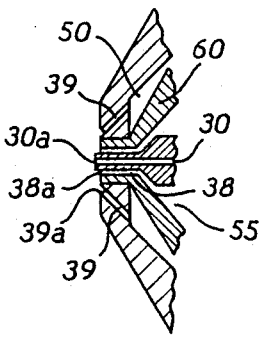
FIG. 3 is a partial cross section III—III of FIG. 1.
Figure 1:
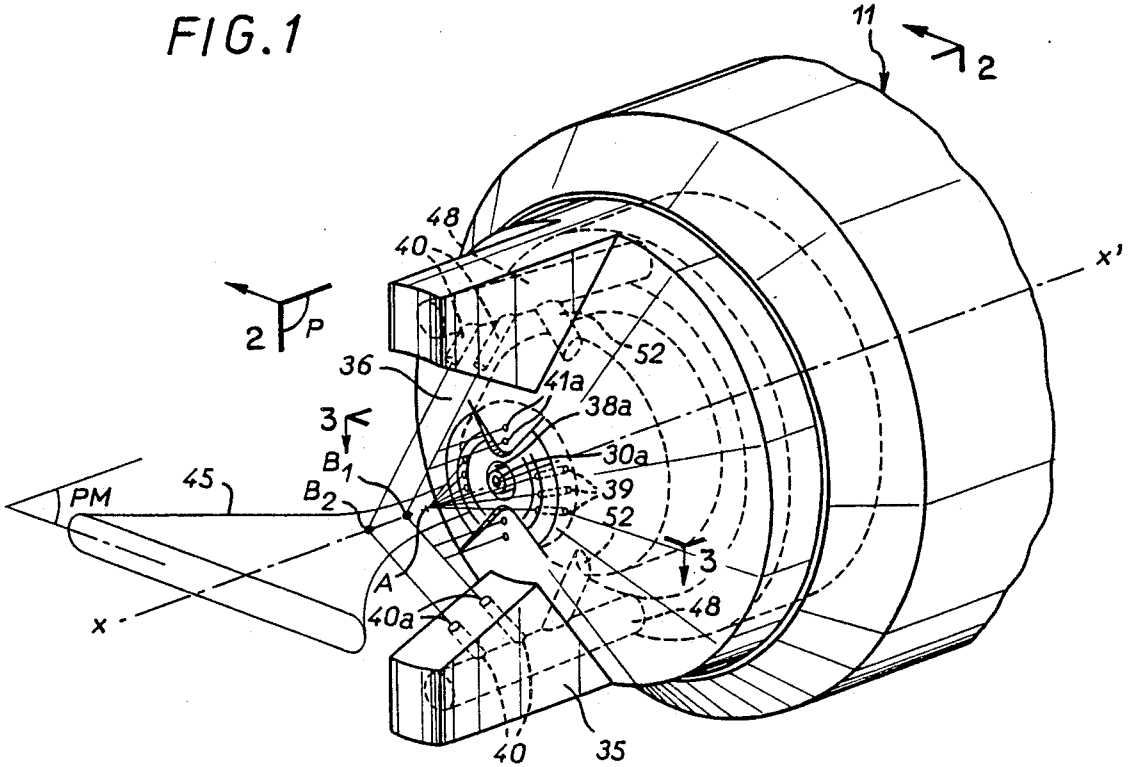
FIG. 1 is a general perspective view of the end part of the device according to the invention, and more especially of the spray nozzle.
Figure 2:
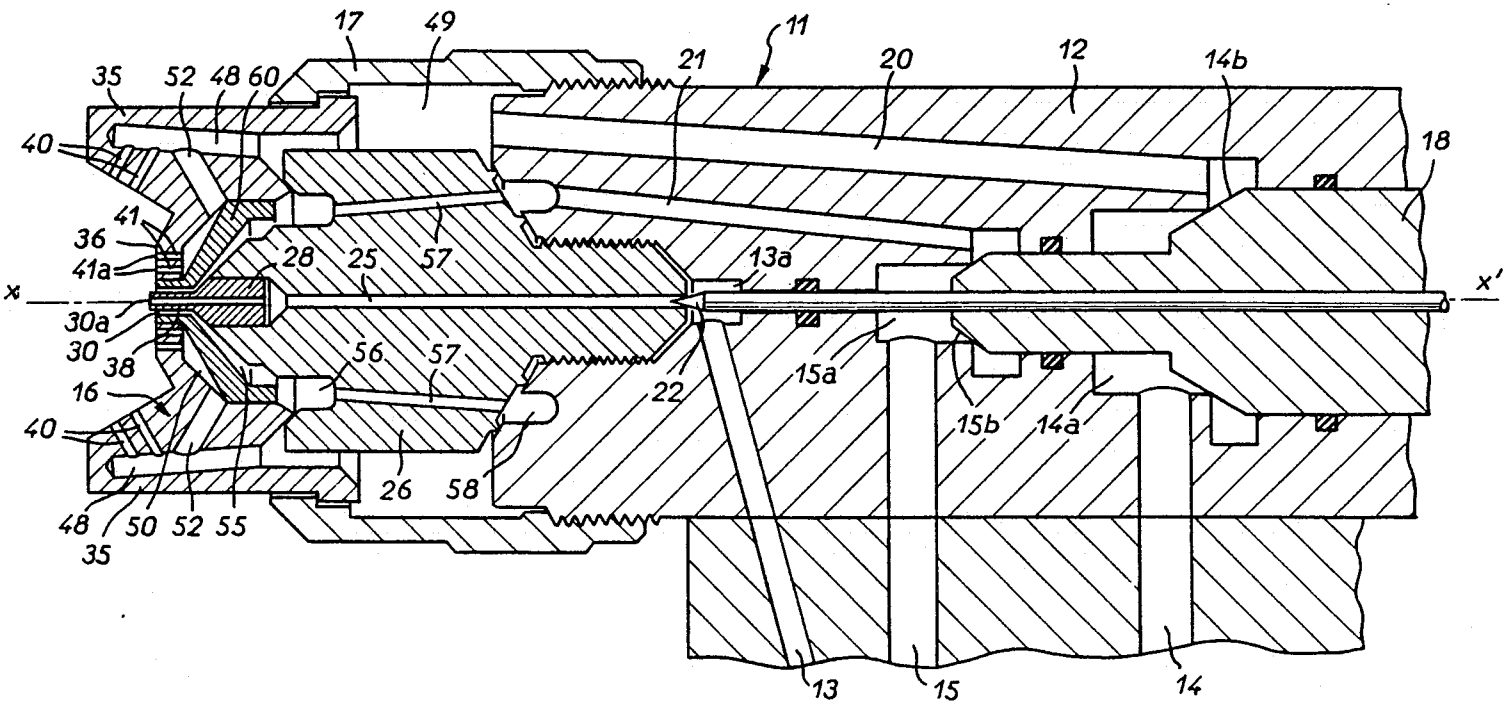
FIG. 2 is a partial representation of the device according to the invention viewed in a longitudinal cross-section II—II in a plane P represented in FIG. 1.

The liquid spraying device 11 comprises a body 12, whereof an approximately cylindrical portion has been represented and wherein are defined a number of ducts able to be placed in communication with a liquid inlet 13 (in particular paint or a varnish), a first compressed air inlet 14 and a second compressed air inlet 15. A spray nozzle 16 is fixed to one end of the body 12, by means of a threaded sleeve 17. The liquid inlet 13 is represented here by a duct that emerges in a chamber **13*a*; this duct is connected to a source of liquid under pressure, not shown. The compressed air inlets 14 and 15, also represented by ducts, emerge in chambers 14*a* and 15*a* and are connected to compressed air sources, not shown, that are independent, that is to say the pressures of which can be adjusted separately. Body 12 houses an air control needle valve 18 slidingly mounted along an axis x x'. It should be noted that the three chambers 13*a*, 14*a* and 15*a* are aligned along this axis, which is also the axis of ejection of the liquid. The needle valve 18 comprises two frustoconical faces 14*b*, 15*b* controlling the placing of chambers 14*a*, 15*a* in communication with air dilstribution ducts 20, 21 respectively. A paint control needle valve 22 is also slidingly mounted along the axis x x'. It moves partly within needle valve 18 and partly within the body 12. In controls the placing of chamber 13*a* in communication with a paint distribution duct 25 axially defined (still along axis x x') in an insert 26. The latter is intercalated between one end of body 12 and spray nozzle 16; it is screwed into a threaded portion of the said body. At the end of insert 26. In the prolongation of duct 25, is located a liquid projection nozzle 28 ending in a liquid ejection channel 30 which projects through the spray nozzle, in the centre thereof. The axis of this channel is, of course, axis x x'. The spray nozzle comprises two horns 35, symmetrical in respect of axis x x', parallel and projecting on the sides of a substantially circular frontal face 36 in the centre of which emerges the liquid ejection channel 30, via an orifice 30*a***. Air ejection channels are provided in the spray nozzle. According to an arrangement known per se, the following channels are differentiated:

an entrainment air ejection channel 38, with an annular cross-section and arranged coaxially and parallel to the liquid ejection channel 30. This channel 38 thus emerges, via an anular orifice **38*a* on circular face 36; this single annular channel could, of course, be replaced by several channels parallel to channel 30 and regularly distributed over a cylindrical surface, spraying air ejection channels 39, oblique in relation to axis x x' and the ejection axes of which converge at A on this axis, downstream of orifice 30*a*, in relation to the direction of ejection of the liquid; orifices 39*a* of these channels also emerge on circular face 36, air stream shaping air ejection channels 40, provided in the horns 35, oblique in relation to axis x x' and arranged in pairs; they are located in a plane P containing axis x x' and the orifices 40*a* of these channels emerge on the opposite faces of horns 35; the axes of these channels converge two by two on axis x x' at points B1, B2 . . . spaced out along this axis, downstream of point A, protection air ejection channels 41 located here in the plan P, orientated parallel to axis x x' and the orifices 41*a* of which emerge on the said circular face 36; the jets of air issuing from these channels primarily prevent splashes of sprayed liquid from being deposited on horns 35; in addition, these jets of air also contribute to the formation of the stream as they slightly "crush" the jets of air from orifices 40*a*, which limits the risk of having a stream that is hollowed out or cut off in the vicinity of plane P. Channels 41** can thus also be considered as forming air ejection channels.

The plane PM containing axis x x' and normal to plane P is defined as being the desired median plane of the fan-shaped stream 45 of sprayed liquid. It should be noted that the above-mentioned air ejection channels, particularly channels 39 and 40, bear for the sake of conventience the names conventionally given to them although the analysis set forth above tends to demonstrate that their action is substantially more complex.

According to one important feature of the invention, the entrainment air ejection channel 38 (or the channels performing this function) is independent of the others and designed to be supplied with compressed air at a pressure generally different from that (those) of the other air ejection channels. It would be possible to contemplate the existence of three compressed air sources, adjustable indenpendently of one another, one for channel 38, one for channels 39 and one for channels 40 and 41.

According to another advantageous feature of the invention, however, the said spraying air ejection channels 39 and the said shaping air ejection channels 40 and 41 communicate. To achieve this, the internal orifices of channels 40 emerge in dusts 48 provided in the horns 35, and communicate with the said first air inlet 14 (via an annular chamber 49 defined between the insert 26 and sleeve 17 and in which emerges duct 20), the internal orifices of channels 39 and 41 emerge in a first cavity 50 defined in the spray nozzle and ducts 48 communicate with cavity 50 via bores 52 provided, obliquely, in horns 35.

Furthermore, the internal orifice of the entrainment air ejection channel emerges in a second cavity 55 in communication with the said second compressed air inlet 15, via an annular chamber 56 defined at the junction of the spray nozzle 16 and the insert 26, channels 57 provided through insert 26, another annular chamber 58 defined at the junction of the insert 26 and the body 12, the channel 21 emerging in this chamber 58. This second cavity 55 is partly delimited by an element of revolution 60 generally conical in shape, inserted between the spray nozzle 16 and the insert 26. The said element of revolution 60 forms a separating wall between the said first cavity 50 and thge said second cavity 55. It is the presence of this element that makes it possible to "dissociate" the entrainment air from the spraying and/or shaping air.

As already mentioned, the use of the device that has just been described is very different from that of the known devices and, in particular, adjustments are simpler and faster. Indeed, the fineness of spraying depends only on the adjustment of the flow of air from forming air ejection channels 40 and 41 and the spraying air channels 39, that is to say the adjustment of the air pressure applied to air inlet 14. The shape of the stream is practically determined and "stabilized" by construction by suitably choosing the cross-sections of the different air ejection channels. As to the openings of the fan, this is directly adjusted by the flow rate of air from the entrainment channel 38. This adjustment can be effected independently of the others and no variation in the other spraying parameters is observed. This adjustment is thus made very simply by acting on the air pressure applied to the air inlet 15.

Furthermore, one notes less soiling of the spray nozzle during use and, in particular, the absence of splashes on the hours 35 and the face 36, at each actuation. This advantage is attributed to the fact that, at the moment of retraction of the needle valve 18, the entrainment air is ejected slightly in advance of the spraying air, given the air paths defined in the device. The non-sprayed liquid is thus correctly channelled by the entrainment air up to its point of spraying.

There is claimed:

1. Pneumatic liquid spraying device comprising a spray nozzle in the center of which is provided a liquid ejection channel and further comprising stream shaping air ejection channels, spraying air ejection channels, and at least one entrainment air ejection channel, said at least one entrainment air ejection channel being provided coaxially and parallel to said liquid ejection channel and emerging on one frontal face of said spray nozzle on which also emerges said liquid ejection channel, characterized in that said spraying air ejection channels emerge on said frontal face and extend obliquely to the axis of said liquid ejection channel for forming spraying air streams directed toward a first region along the liquid channel axis, said shaping air ejection channels form air streams directed toward a second region along the liquid ejection channel axis downstream of the first region, and said at least one entrainment air ejection channel is independent of the other aforementioned air channels and is designed to be supplied by specific compressed air at a pressure generally different from that of each of the other aforementioned air ejection channels.

2. Pneumatic liquid spraying device according to claim 1, characterized in that said spraying air ejection channels and said stream shaping air ejection channels communicate therebetween.

3. Pneumatic liquid spraying device according to claim 2, comprising two parallel horns projecting on the sides of said frontal face of said spray nozzle, said horns being arranged symmetrical with respect to the longitudenial axis of said liquid ejection channel and including stream shaping air ejection channels located in one plane containing said axis, some spraying air ejection channels emerging on both sides of said plane and being symmetrical with respect to that plane, characterized in that internal orifices of said stream shaping air ejection channels emerge into ducts in communication with a first compressed air inlet, that the internal orifices of said spraying air ejection channels emerge in a first cavity and that said ducts commiunicate with said first cavity by bores in said horns.

4. Pneumatic liquid spraying device according to claim 3, characterized in that said entrainment air ejection channel communicates with a second cavity connected to a second compressed air inlet.

5. Pneumatic liquid spraying device according to claim 4, characterized in that said second cavity is partly delimited by an element of revolution generally conical in shape and coaxial to said spray nozzle.

6. Pneumatic liquid spraying device according to claim 5, characterized in that said element of revolution forms a separating wall between said first cavity and second cavity.

7. Pneumatic liquid spraying device according to claim 2, characterized in that protection air ejection channels communicate with said stream shaping air ejection channels.

8. Pneumatic liquid spraying device according to claim 3, characterized in that protection air ejection channels communicate with said stream shaping air ejection channels provided in said horns.

9. Pneumatic liquid spraying device according to claim 4, characterized in that protection air ejection channels communicate with said stream shaping air ejection channels provided in said horns.

10. Pneumatic liquid spraying device according to claim 5, characterized in that protection air ejection channels communicate with said stream shaping air ejection channels provided in said horns.

11. Pneumatic liquid spraying device according to claim 6, characterized in that protection air ejection channels communicate with said stream shaping air ejection channels provided in said horns.

* * * * *